US009371989B2

(12) United States Patent
Boardman et al.

(10) Patent No.: US 9,371,989 B2
(45) Date of Patent: Jun. 21, 2016

(54) COMBUSTOR NOZZLE AND METHOD FOR SUPPLYING FUEL TO A COMBUSTOR

(75) Inventors: Gregory Allen Boardman, Greer, SC (US); Geoffrey David Myers, Simpsonville, SC (US); William Thomas Ross, Greer, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 999 days.

(21) Appl. No.: 13/110,256

(22) Filed: May 18, 2011

(65) Prior Publication Data

US 2012/0291447 A1 Nov. 22, 2012

(51) Int. Cl.

| | |
|---|---|
| ***F02C 7/22*** | (2006.01) |
| ***F23D 11/16*** | (2006.01) |
| ***F23L 7/00*** | (2006.01) |
| ***F23R 3/34*** | (2006.01) |

(52) U.S. Cl.

CPC ..... *F23D 11/16* (2013.01); *F23L 7/005* (2013.01); *F23R 3/343* (2013.01); *F23C 2900/07021* (2013.01); *F23L 2900/07008* (2013.01)

(58) Field of Classification Search

CPC ..... F23D 11/16; F23L 2900/07008; F23L 7/005; F23C 2900/07021; F23R 3/343

USPC ..... 60/737, 742, 748, 746–747, 39.55

See application file for complete search history.

(56) References Cited

U.S. PATENT DOCUMENTS

| | | | | |
|---|---|---|---|---|
| 1,536,046 | A * | 5/1925 | Anthony | 239/406 |
| 2,551,276 | A * | 5/1951 | McMahan | 60/740 |
| 3,028,102 | A * | 4/1962 | Davies et al. | 239/404 |
| 3,045,997 | A * | 7/1962 | Hudson | 239/132.3 |
| 4,023,351 | A * | 5/1977 | Beyler et al. | 60/742 |
| 4,040,251 | A | 8/1977 | Heitmann et al. | |
| 4,139,157 | A * | 2/1979 | Simmons | 239/406 |
| 4,589,260 | A * | 5/1986 | Krockow | 60/737 |
| 4,798,330 | A * | 1/1989 | Mancini et al. | 239/406 |
| 4,850,194 | A * | 7/1989 | Fuglistaller et al. | 60/737 |

(Continued)

FOREIGN PATENT DOCUMENTS

| | | | |
|---|---|---|---|
| CN | 1218888 | A | 6/1999 |
| CN | 1763434 | A | 4/2006 |
| CN | 101008479 | A | 8/2007 |

OTHER PUBLICATIONS

Unofficial English translation of Office Action issued in connection with corresponding CN Application No. 201210166904.2 on Jan. 28, 2015.

*Primary Examiner* — Ted Kim

(74) *Attorney, Agent, or Firm* — Dority & Manning, PA

(57) ABSTRACT

A combustor nozzle includes a first and second liquid fuel passages that terminate at first and second fuel ports. A first diluent passage terminates at a first diluent outlet radially surrounding the second fuel ports. A second diluent passage terminates at a second diluent outlet between the first diluent outlet and the second fuel ports. A third diluent passage surrounds at least a portion of the first and second diluent passages. A method for supplying fuel to a combustor includes flowing a liquid fuel through a first fuel passage and flowing an emulsified liquid fuel through a second fuel passage. The method further includes flowing a first diluent through a shroud surrounding the second fuel passage to a first diluent passage surrounding at least a portion of the second fuel passage and flowing a second diluent through a second diluent passage radially disposed between the first diluent passage and the second fuel passage.

20 Claims, 6 Drawing Sheets

(56) References Cited

U.S. PATENT DOCUMENTS

| | | | | |
|---|---|---|---|---|
| 5,450,725 | A * | 9/1995 | Takahara et al. | 60/737 |
| 5,451,160 | A * | 9/1995 | Becker | 431/284 |
| 5,505,045 | A | 4/1996 | Lee et al. | |
| 5,657,632 | A * | 8/1997 | Foss | 60/742 |
| 5,713,205 | A * | 2/1998 | Sciocchetti et al. | 60/740 |
| 6,132,202 | A | 10/2000 | Eroglu et al. | |
| 6,272,840 | B1 | 8/2001 | Crocker et al. | |
| 6,367,262 | B1 | 4/2002 | Mongia et al. | |
| 7,007,477 | B2 * | 3/2006 | Widener | 60/737 |
| 7,546,735 | B2 | 6/2009 | Widener | |
| 7,878,000 | B2 | 2/2011 | Mancini et al. | |
| 8,347,631 | B2 * | 1/2013 | Bailey et al. | 60/742 |
| 8,418,469 | B2 * | 4/2013 | Myers et al. | 60/748 |
| 2004/0045302 | A1 | 3/2004 | Brown | |
| 2007/0234733 | A1 | 10/2007 | Harris et al. | |
| 2010/0154424 | A1 * | 6/2010 | Twardochleb et al. | 60/740 |

* cited by examiner

COMBUSTOR NOZZLE AND METHOD FOR SUPPLYING FUEL TO A COMBUSTOR

FIELD OF THE INVENTION

The present invention generally involves a combustor nozzle and a method for supplying fuel to a combustor. In particular embodiments of the present invention, the combustor nozzle may supply liquid and emulsified fuel to the combustor.

BACKGROUND OF THE INVENTION

Combustors are commonly used in industrial and commercial operations to ignite fuel to produce combustion gases having a high temperature and pressure. For example, an industrial gas turbine may include one or more combustors to generate power or thrust. A typical commercial gas turbine used to generate electrical power may include an axial compressor at the front, one or more combustors around the middle, and a turbine at the rear. Ambient air may be supplied to the compressor, and rotating blades and stationary vanes in the compressor progressively impart kinetic energy to the working fluid (air) to produce a compressed working fluid at a highly energized state. The compressed working fluid exits the compressor and flows through one or more nozzles in each combustor where the compressed working fluid mixes with fuel and ignites to generate combustion gases having a high temperature and pressure. The combustion gases expand in the turbine to produce work. For example, expansion of the combustion gases in the turbine may rotate a shaft connected to a generator to produce electricity.

The fuel supplied to the combustor may be a liquid fuel, a gaseous fuel, or a combination of liquid and gaseous fuels. If the liquid and/or gaseous fuel is not evenly mixed with the compressed working fluid prior to combustion, localized hot spots may form in the combustor. The localized hot spots may increase the production of nitrous oxides in the fuel rich regions, while the fuel lean regions may increase the production of carbon monoxide and unburned hydrocarbons, all of which are undesirable exhaust emissions. In addition, the fuel rich regions may increase the chance for the flame in the combustor to flash back into the nozzles and/or become attached inside the nozzles which may damage the nozzles. Although flame flash back and flame holding may occur with any fuel, they occur more readily with high reactive fuels, such as hydrogen, that have a higher burning rate and a wider flammability range.

A variety of techniques exist to allow higher operating combustor temperatures while minimizing undesirable exhaust emissions, flash back, and flame holding. Many of these techniques seek to reduce localized hot spots to reduce the production of undesirable emissions and/or reduce low flow zones to prevent or reduce the occurrence of flash back or flame holding. For example, continuous improvements in nozzle designs result in more uniform mixing of the fuel and compressed working fluid prior to combustion to reduce or prevent localized hot spots from forming in the combustor. Alternately, or in addition, nozzles have been designed to ensure a minimum flow rate of fuel and/or compressed working fluid through the nozzle to cool the nozzle surfaces and/or prevent the combustor flame from flashing back into the nozzle. In still further embodiments, water may be added to the fuel to produce an emulsified fuel, and the nozzle may mix the emulsified fuel with the compressed working fluid prior to combustion to reduce the peak flame temperature, and thus nitrous oxide production, in the combustor. However, the emulsified fuel, if not adequately dispersed, may result in flame instability and/or increased undesirable exhaust emissions. Therefore, continued improvements in the combustor nozzle designs and methods for supplying fuel to the combustor would be useful to improve combustor efficiency, reduce undesirable emissions, and/or prevent flash back and flame holding events.

BRIEF DESCRIPTION OF THE INVENTION

Aspects and advantages of the invention are set forth below in the following description, or may be obvious from the description, or may be learned through practice of the invention.

One embodiment of the present invention is a combustor nozzle that includes a center body and a first fuel passage inside the center body, wherein the first fuel passage terminates at a first fuel port. A second fuel passage inside the center body and circumferentially surrounding at least a portion of the first fuel passage terminates at a plurality of second fuel ports radially surrounding the first fuel port. A first diluent passage inside the center body and circumferentially surrounding at least a portion of the second fuel passage terminates at a first diluent outlet radially surrounding the plurality of second fuel ports. A shroud circumferentially surrounds at least a portion of the center body to define a passage between the center body and the shroud. A plurality of diluent ports through the shroud provide fluid communication through the shroud to the first diluent passage. A second diluent passage radially disposed between the first diluent passage and the second fuel passage terminates at a second diluent outlet radially inward from the first diluent outlet.

Another embodiment of the present invention is a combustor nozzle that includes a first liquid fuel passage that terminates at a first fuel port and a second liquid fuel passage circumferentially surrounding at least a portion of the first liquid fuel passage that terminates at a plurality of second fuel ports radially surrounding the first fuel port. A first diluent passage surrounding at least a portion of the second liquid fuel passage terminates at a first diluent outlet radially surrounding the plurality of second fuel ports, and a second diluent passage radially disposed between the first diluent passage and the second fuel passage terminates at a second diluent outlet between the first diluent outlet and the plurality of second fuel ports. A third diluent passage surrounds at least a portion of the first and second diluent passages.

Embodiments of the present invention may also include a method for supplying fuel to a combustor that includes flowing a liquid fuel through a first fuel passage in a center body and flowing an emulsified liquid fuel through a second fuel passage in the center body, wherein the second fuel passage surrounds at least a portion of the first fuel passage. The method further includes flowing a first diluent through a shroud surrounding the second fuel passage to a first diluent passage surrounding at least a portion of the second fuel passage, wherein the first diluent passage is inside the center body and flowing a second diluent through a second diluent passage radially disposed between the first diluent passage and the second fuel passage.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
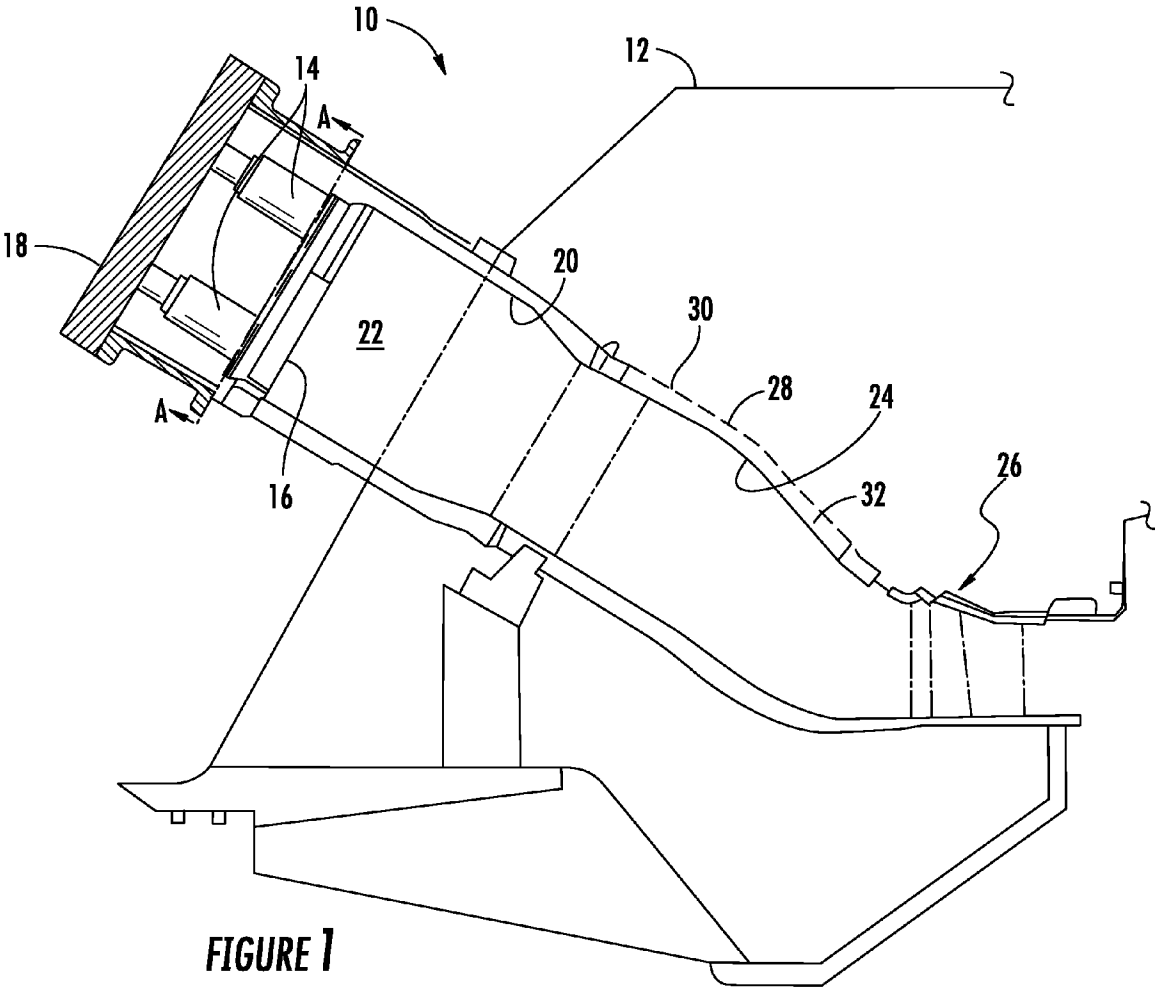
FIG. 1 is a simplified cross-section view of an exemplary combustor according to one embodiment of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention provide a combustor nozzle and a method for supplying fuel to a combustor. In particular embodiments of the present invention, the combustor nozzle may inject a diluent proximate to a liquid fuel and/or emulsified liquid fuel to enhance mixing and/or evaporation of the fuel prior to combustion. It is anticipated that the enhanced mixing and/or evaporation of the fuel prior to combustion will reduce the production of undesirable emissions. In addition, it is anticipated that the injection of the diluent proximate to the liquid fuel and/or emulsified liquid fuel will reduce or prevent flash back or flame holding events. Although described generally in the context of a combustor nozzle incorporated into a combustor of a gas turbine, embodiments of the present invention may be applied to any combustor and are not limited to a gas turbine combustor unless specifically recited in the claims.

FIG. 1 shows a simplified cross-section view of an exemplary combustor 10, such as would be included in a gas turbine, according to one embodiment of the present invention. A casing 12 may surround the combustor 10 to contain the compressed working fluid flowing to the combustor 10. As shown, the combustor 10 may include one or more nozzles 14 radially arranged between a top cap 16 and an end cover 18. Various embodiments of the combustor 10 may include different numbers and arrangements of nozzles 14. For example, in the embodiment shown in FIG. 1, the combustor 10 includes five nozzles 14 radially arranged in the top cap 16. The top cap 16 and a liner 20 generally surround a combustion chamber 22 located downstream from the nozzles 14, and a transition piece 24 downstream from the liner 20 connects the combustion chamber 22 to a turbine inlet 26. As used herein, the terms "upstream" and "downstream" refer to the relative location of components in a fluid pathway. For example, component A is upstream from component B if a fluid flows from component A to component B. Conversely, component B is downstream from component A if component B receives a fluid flow from component A.

An impingement sleeve 28 with flow holes 30 may surround the transition piece 24 to define an annular passage 32 between the impingement sleeve 28 and the transition piece 24. The compressed working fluid may pass through the flow holes 30 in the impingement sleeve 28 to flow through the annular passage 32 to provide convective cooling to the transition piece 24 and liner 20. When the compressed working fluid reaches the end cover 18, the compressed working fluid reverses direction to flow through the one or more nozzles 14 where it mixes with fuel before igniting in the combustion chamber 22 to produce combustion gases having a high temperature and pressure.

Figure 2:
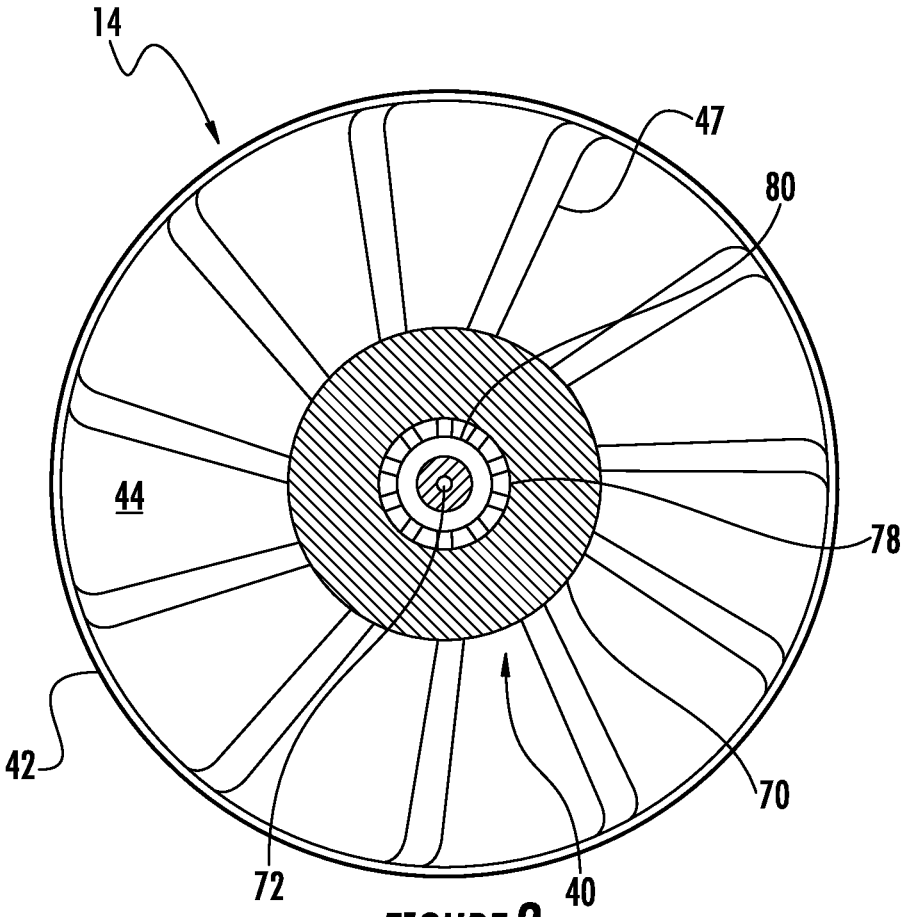
FIG. 2 is an upstream axial plan view of a nozzle shown in FIG. 1 taken along line A-A.
Figure 3:
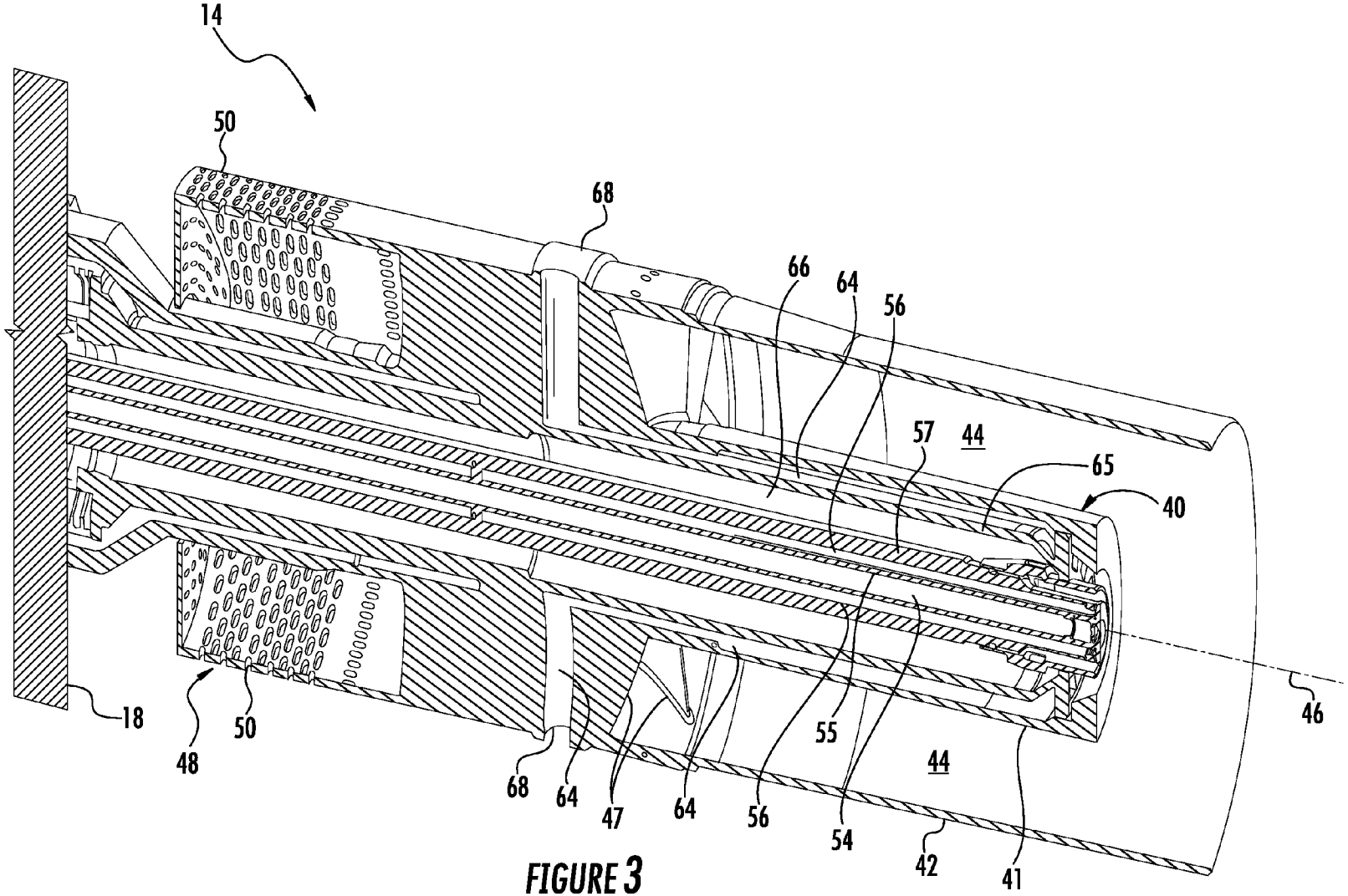
FIG. 3 is a cross-sectional perspective view of a nozzle shown in FIG. 2 according to one embodiment of the present invention.

FIG. 2 provides an upstream axial plan view of the nozzle 14 shown in FIG. 1 taken along line A-A, and FIG. 3 provides a cross-sectional perspective view of the nozzle 14 shown in FIG. 2 according to one embodiment of the present invention. As shown, the nozzle 14 generally comprises a center body 40 and a shroud 42 that circumferentially surrounds at least a portion of the center body 40 to define an annular passage 44 between the center body 40 and the shroud 42. The center body 40 includes an outer sleeve 41. The center body 40 may be aligned with an axial centerline 46 of the nozzle 14 and may extend upstream through the end cover 18 to provide fluid communication from the end cover 18, through the center body 40, and into the combustion chamber 22. The annular passage 44 defined between the center body 40 and the shroud 42 may include one or more swirler vanes 47 that impart a tangential velocity to the compressed working fluid flowing through the annular passage 44. As shown most clearly in FIG. 3, at least a portion of the compressed working fluid may enter the nozzle 14 through an inlet flow conditioner 48 between the shroud 42 and the center body 40. The inlet flow conditioner 48 may comprise, for example, a perforated surface 50 that may extend circumferentially around an upstream portion of the annular passage 44 between the center body 40 and the shroud 42. In this manner, the annular passage 44 provides fluid communication for at least a portion of the compressed working fluid to flow through inlet flow conditioner 48, across the swirler vanes 47, and into the combustion chamber 22.

As shown in FIGS. 2 and 3, the nozzle 14 further includes a plurality of substantially concentric and/or co-axial fluid passages that may extend axially through at least a portion of the center body 40. Specifically, first and second fuel passages 54, 56 may extend axially inside the center body 40. In one embodiment, as shown in FIG. 3, the first fuel passage 54 is defined with an inner tube 55 that extends coaxially with the center body 40 and the second fuel passage 56 is defined radially between the inner tube 55 and a second intermediate tube 57. As shown in FIG. 3, the first fuel passage 54 may be substantially coincident with the axial centerline 46 of the nozzle 14, with the second fuel passage 56 circumferentially surrounding at least a portion of the first fuel passage 54. The first and second fuel passages 54, 56 provide fluid communication for liquid and/or emulsified fuel to flow from the end cover 18, through the center body 40, and into the combustion chamber 22. Possible liquid fuels supplied to the combustor 10 may include, for example, fuel oil, naptha, petroleum, coal tar, crude oil, and gasoline, and water or steam may be added to the various liquid fuels to produce the emulsified fuel. In particular embodiments, for example, the first fuel passage 54 may supply liquid or pilot fuel for start up and lower power operations, and the second fuel passage 56 may supply emulsified liquid fuel for higher power operations.

First and second diluent passages 64, 66 may similarly extend axially inside the center body 40, with the second diluent passage 66 radially disposed between the first diluent passage 64 and the first and/or second fuel passages 54, 56. In one embodiment, the first diluent passage 64 is defined between the center body 40 outer sleeve 41 and a first intermediate tube 65 that extends coaxially within the center body 40 and that at least partially surrounds the second intermediate tube 57. The second diluent passage 66 is defined between the first intermediate tube 65 and the second intermediate tube 57. As shown in FIG. 3, a portion of the first diluent passage 64 may extend radially through the annular passage 44 and shroud 42 and connect to one or more diluent ports 68 in the shroud 42. In this manner, the diluent ports 68 provide fluid communication for the compressed working fluid, a type of diluent, to flow through the shroud 42 and into and through the first diluent passage 64. The second diluent passage 66 provides fluid communication for a diluent to flow from the end cover 18, through the center body 40, and into the combustion chamber 22. Possible diluents supplied through the second diluent passage 66 may include, for example, water, steam, fuel additives, various inert gases such as nitrogen, various non-flammable gases such as carbon dioxide, or the compressed working fluid supplied to the combustor 10 from the compressor (not shown).

Figure 4:
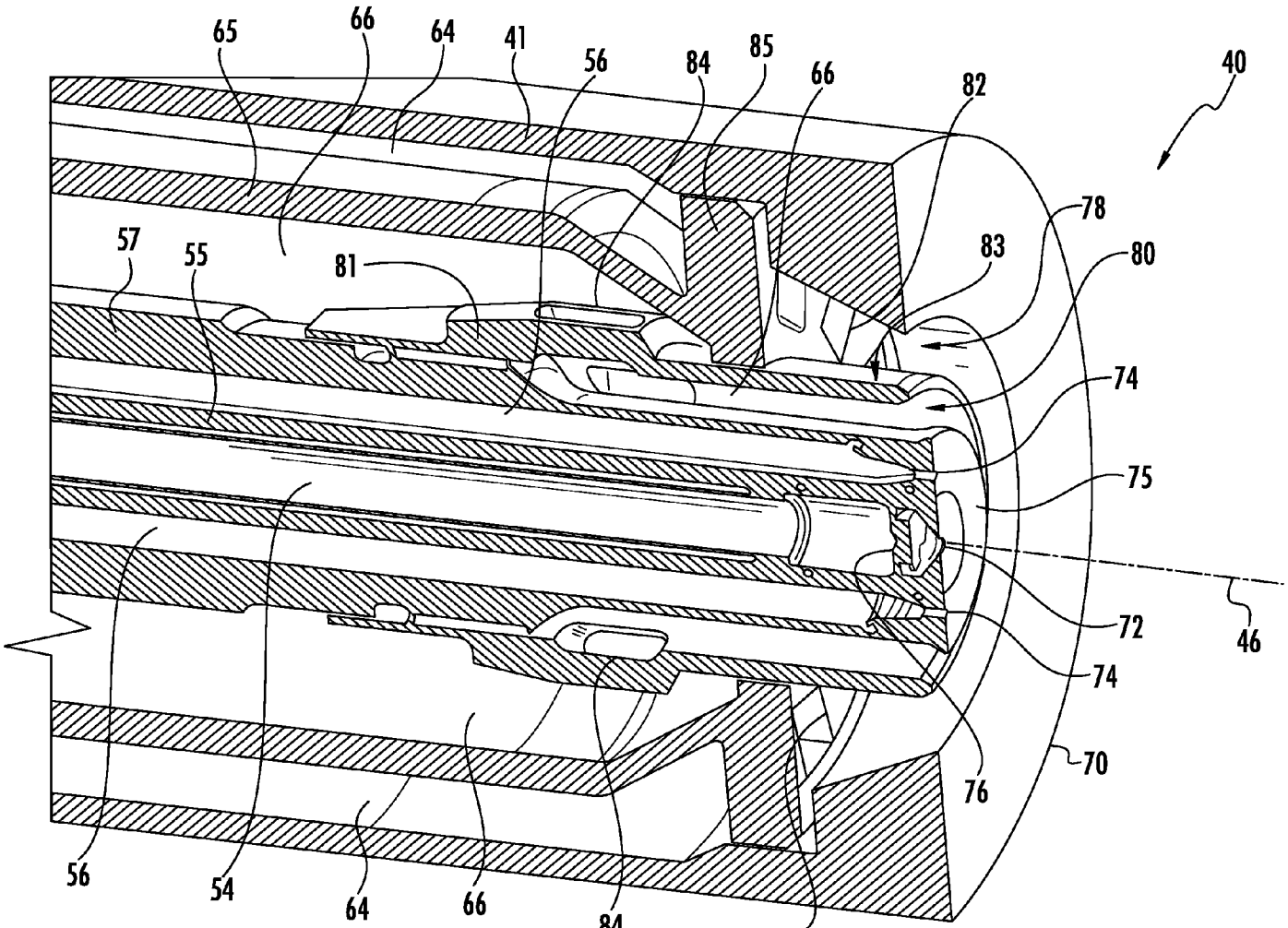
FIG. 4 is an enlarged cross-sectional perspective view of a portion of the center body shown in FIG. 2 according to one embodiment of the present invention.
Figure 5:
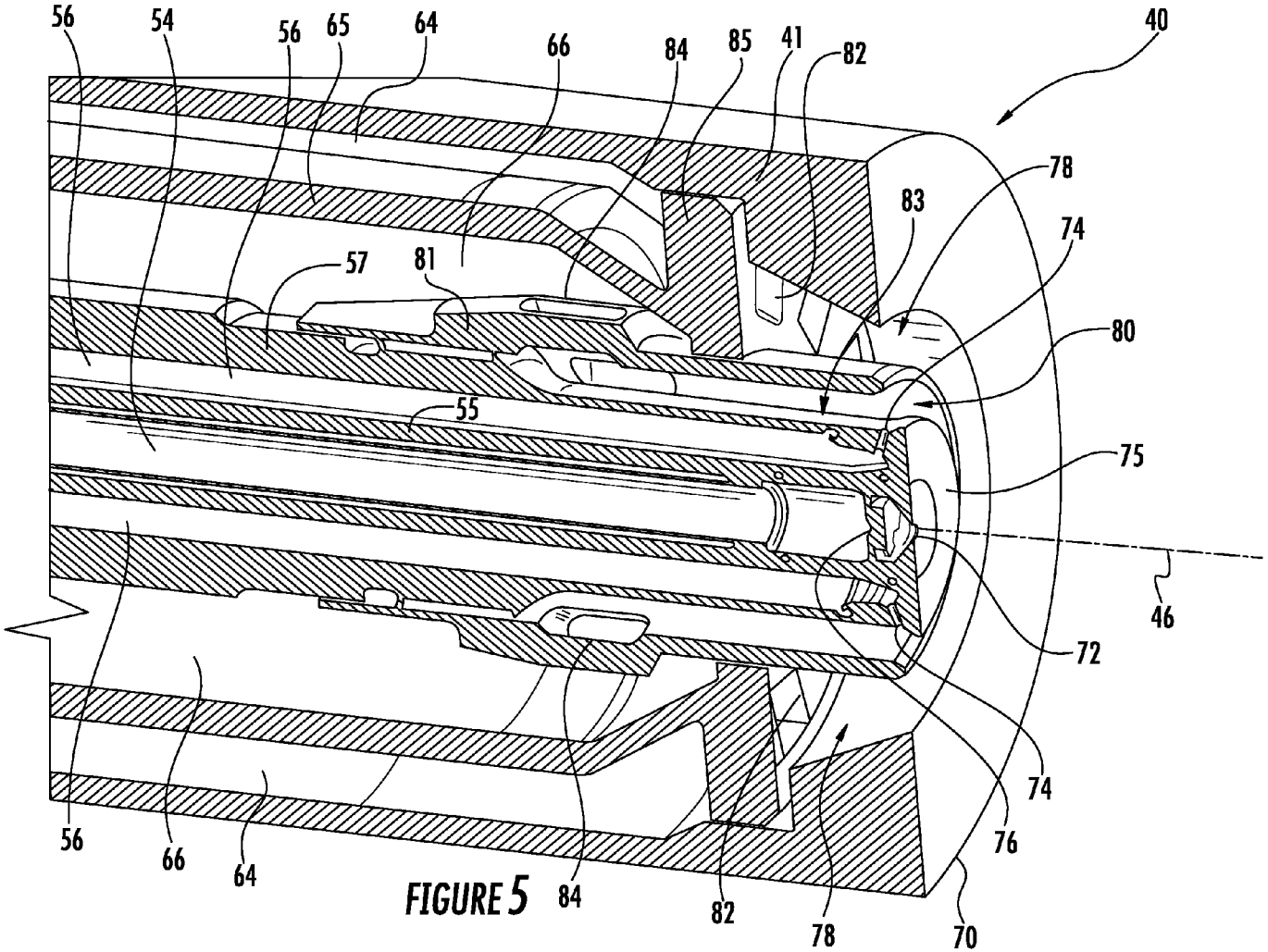
FIG. 5 is an enlarged cross-sectional perspective view of a portion of the center body shown in FIG. 2 according to a second embodiment of the present invention.
Figure 6:
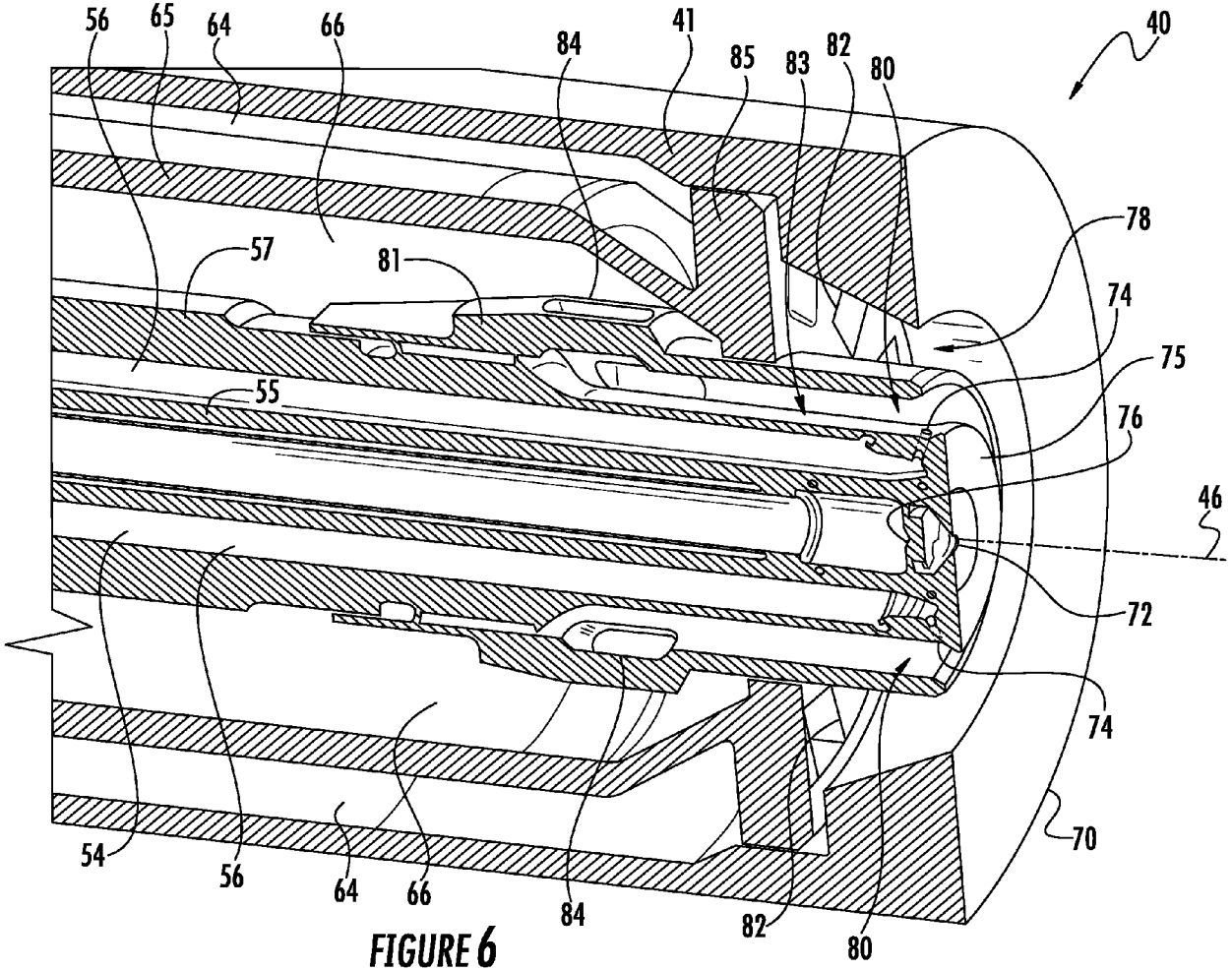
FIG. 6 is an enlarged cross-sectional perspective view of a portion of the center body shown in FIG. 2 according to a third embodiment of the present invention.

FIGS. 4, 5, and 6 provide enlarged cross-sectional perspective views of a portion of the center body 40 shown in FIG. 2 according to various embodiments of the present invention. As shown in each embodiment, the various fluid passages inside the center body 40 may terminate at outlets proximate to or coincident with a downstream surface 70 of the center body 40. Specifically, the first fuel passage 54 may terminate at a first fuel port 72 proximate to the downstream surface 70, and the second fuel passage 56 may terminate at a plurality of second fuel ports 74 that radially surround the first fuel port 72. In one embodiment, the first fuel port 72 and the second fuel ports 74 are defined by an end wall 75 that extends radially between a downstream end of the inner tube 55 and a downstream end of the second intermediate tube 57. The first fuel passage 54 may further include a fuel swirler 76 upstream from the first fuel port 72 to impart a radial swirl or vortex to the fuel exiting the first fuel port 72. Similarly, the second fuel ports 74 may be aligned parallel to the axial centerline 46, as shown in FIG. 4, or angled with respect to the axial centerline 46 to impart a radial and/or azimuthal swirl to the fuel exiting the second fuel ports 74, as shown in FIGS. 5 and 6, respectively.

The first diluent passage 64 may similarly terminate at a first diluent outlet 78, and the second diluent passage 66 may terminate at a second diluent outlet 80. The first diluent outlet 78 may be disposed radially outward from the first and second fuel ports 72, 74, and defined between a flow sleeve 81 that circumferentially surrounds an end portion 83 of the second intermediate tube 57. The flow sleeve 81 and the end portion 83 of the intermediate tube 57 define an annular flow passage or the second diluent passage 66 therebetween. The first diluent passage 64 may include a plurality of diluent swirler vanes 82 proximate to the first diluent outlet 78 to impart a radial swirl to the diluent exiting the first diluent outlet 78. The plurality of diluent swirler vanes 82 is defined by an annular disk 85 disposed at the downstream end of the first intermediate tube 65. The disk 85 is axially offset upstream from the downstream surface 70 of the center body 40. The second diluent outlet 80 may be disposed radially between the first diluent outlet and the second fuel ports 74 so that the second diluent outlet 80 circumferentially surrounds the first and second fuel ports 72, 74 proximate to the downstream surface 70 of the center body 40. In one embodiment, the second diluent outlet 80 is defined by and between the flow sleeve 81 and the second intermediate tube 57. In addition, the second diluent passage 66 may include a plurality of slots 84 defined by and circumferentially spaced about the flow sleeve 81. The slots 84 are angled with respect to the axial centerline 46 to impart radial swirl to the diluent exiting the second diluent outlet 80. The swirl created by the diluent swirler vanes 82 in the first diluent passage 64 and the slots 84 in the second diluent passage 66 may be in the same direction or opposite directions, depending on the particular embodiment.

The particular arrangement and orientation of the first and second fuel ports 72, 74 and first and second diluent outlets 78, 80 enhances mixing between the liquid and/or emulsified fuel flowing through the fuel ports 72, 74 and the diluent flowing through the diluent outlets 78, 80. Specifically, the diluent exiting the second diluent outlet 80 impacts and mixes with the fuel, which may be emulsified, exiting the second fuel outlets 74 to enhance mixing and/or evaporation of the fuel. In addition, the compressed working fluid flowing between the passage 44 between the shroud 42 and the center body 40, also referred to as a third diluent passage 44, interacts with the fuel and diluent flowing through the first and second fuel ports 72, 74 and first and second diluent outlets 78, 80 to further enhance mixing and evaporation of the fuel prior to combustion.

The enhanced mixing and evaporation provided by the first, second, and third diluent passages 64, 66, 44 thus allows a reduced amount of water or steam to be added to the emulsified fuel exiting the second fuel port 74 while still providing the same benefits. Specifically, the diluent flowing through the first, second, and third diluent passages 64, 66, 44 enhances dispersal and evaporation of the emulsified fuel without requiring additional swirling of the emulsified fuel which tends to separate the heavier fuel from the lighter water or steam emulsifier. As a result, the reduced water or steam in the emulsified fuel allows combustion of a leaner fuel mixture while still achieving a desired reduction in flame temperature and undesirable exhaust emissions such as nitrous oxides, carbon monoxide, and unburned hydrocarbons. In addition, the enhanced mixing and evaporation of the emulsified fuel results in less wetting of the liner 20 by fuel, water, or steam, increasing the durability of the liner 20.

The various embodiments of the system shown and described with respect to FIGS. 2-6 may also provide a method for supplying fuel to the combustor 10. The method may include flowing a liquid fuel through the first fuel passage 54 in the center body 40 and flowing an emulsified liquid fuel through the second fuel passage 56 surrounding at least a portion of the first fuel passage 54. The method may further include flowing a first diluent, such as the compressed working fluid, through the shroud 42 surrounding the second fuel passage 56 to the first diluent passage 64 surrounding at least a portion of the second fuel passage 56 and flowing a second diluent through the second diluent passage 66 radially disposed between the first diluent passage 64 and the second fuel passage 56. Particular embodiments of the method may include flowing the emulsified liquid fuel out of the second fuel passage 56 at an angle with respect to the axial centerline 46 and/or flowing a third diluent through the third diluent passage 44 radially disposed between the shroud 42 and the second fuel passage 56. Alternately, or in addition, the method may include swirling at least one of the liquid fuel, emulsified liquid fuel, first diluent, second diluent, and/or third diluent.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A fuel nozzle assembly comprising:

a center body configured to extend axially downstream from an end cover of a combustor, the center body comprising:

a first intermediate tube that extends axially within the center body and a first diluent passage defined therebetween;

an annular disk disposed at a downstream end of the first intermediate tube, wherein the disk is axially offset upstream from a downstream surface of the center body, wherein the disk defines a plurality of circumferentially spaced vanes which provide for fluid communication from the first diluent passage through the disk;

a second intermediate tube that extends axially within the first intermediate tube and through an opening defined by the disk, wherein the second intermediate tube and the first intermediate tube define a second diluent passage therebetween;

an inner tube that extends axially within the second intermediate tube, wherein the inner tube defines a first fuel passage therein and the inner tube and the second intermediate tube define a second fuel passage therebetween, the first fuel passage terminating at first fuel port defined in an end wall that extends radially between a downstream end of the inner tube and a downstream end of the second intermediate tube, the second fuel passage terminating at a plurality of second fuel ports annularly arranged around the first fuel port proximate to the end wall; and a flow sleeve circumferentially surrounding an end portion of the second intermediate tube and extending axially through the disk opening, the flow sleeve and the end portion of the intermediate tube defining an annular flow passage therebetween, wherein the flow sleeve defines a plurality of circumferentially spaced radial passages in fluid communication with the second diluent passage and the annular flow passage.

2. The fuel nozzle assembly as in claim 1, wherein an outer surface of the flow sleeve and an inner wall portion of the center body define a first diluent outlet downstream from the vanes of the disk.

3. The fuel nozzle assembly as in claim 2, wherein an outer surface of the second intermediate tube and an inner surface of the flow sleeve define a second diluent outlet proximate to the end wall of the center body.

4. The fuel nozzle assembly as in claim 1, further comprising a fuel swirler disposed within the inner tube and in fluid communication with the first fuel passage upstream from the first fuel port.

5. The fuel nozzle assembly as in claim 1, wherein the plurality of second fuel ports is angled with respect to an axial centerline of the fuel nozzle assembly to impart at least one of radial and azimuthal swirl to a liquid fuel exiting the plurality of second fuel ports.

6. The fuel nozzle assembly as in claim 1, wherein at least one fuel port of the plurality of second fuel ports extends through the end wall.

7. The fuel nozzle assembly as in claim 1, wherein at least one fuel port of the plurality of second fuel ports extends through a radially outer surface of the second intermediate tube proximate to the end wall.

8. The fuel nozzle assembly as in claim 1, wherein the plurality of vanes defined by the disk are angled to impart angular swirl to a diluent flowing from the first diluent passage through the disk.

9. The fuel nozzle assembly as in claim 1, further comprising a shroud circumferentially surrounding at least a portion of the center body and defining an annular passage therebetween, the fuel nozzle assembly further comprising a plurality of swirler vanes disposed in the annular passage and extending between the center body and the shroud.

10. A fuel nozzle assembly comprising:

a center body configured to extend axially downstream from an end cover of a combustor, the center body comprising:

a first diluent passage defined between the center body and a first intermediate tube that extends axially within the center body and including an annular disk disposed at a downstream end of the first intermediate tube, wherein the disk is axially offset upstream from a downstream surface of the center body, wherein the disk defines a plurality of circumferentially spaced vanes which provide for fluid communication from the first diluent passage through the disk;

a second diluent passage defined between the first intermediate tube and a second intermediate tube that extends axially within the first intermediate tube and through an opening defined by the disk;

a first fuel passage defined within an inner tube that extends axially within the second intermediate tube, the first fuel passage terminating at first fuel port defined in an end wall that extends radially between a downstream end of the inner tube and a downstream end of the second intermediate tube;

a second fuel passage defined between the inner tube and the second intermediate tube and terminating at a plurality of second fuel ports annularly arranged around the first fuel port proximate to the end wall; and an annular flow passage defined between a flow sleeve and the second intermediate tube, the flow sleeve extending circumferentially around an end portion of the second intermediate tube and axially through the disk opening, wherein the flow sleeve defines a plurality of circumferentially spaced radial passages in fluid communication with the second diluent passage and the annular flow passage.

11. The fuel nozzle assembly as in claim 10, further comprising a first diluent outlet defined downstream from the vanes of the disk between a portion of the flow sleeve and an inner wall portion of the center body proximate to the downstream surface.

12. The fuel nozzle assembly as in claim 11, further comprising a second diluent outlet defined between an outer surface of the second intermediate tube and an inner surface of the flow sleeve proximate to the end wall.

13. The fuel nozzle assembly as in claim 10, further comprising a fuel swirler disposed within the first fuel passage upstream from the first fuel port.

14. The fuel nozzle assembly as in claim 10, wherein the plurality of second fuel ports is angled with respect to an axial centerline of the fuel nozzle assembly to impart at least one of radial and azimuthal swirl to a liquid fuel exiting the plurality of second fuel ports.

15. The fuel nozzle assembly as in claim 10, wherein the plurality of vanes defined by the disk are angled to impart angular swirl to a diluent flowing from the first diluent passage through the disk.

16. The fuel nozzle assembly as in claim 10, further comprising a shroud circumferentially surrounding at least a portion of the center body and defining an annular passage therebetween, the fuel nozzle assembly further comprising a plurality of swirler vanes disposed in the annular passage and extending between the center body and the shroud.

17. A combustor comprising:

an outer casing;

an end cover coupled to the outer casing;

a fuel nozzle assembly extending axially downstream from the end cover towards a combustion chamber of the combustor, the fuel nozzle assembly comprising:

a center body configured to extend axially downstream from an end cover of a combustor, the center body comprising:

a first intermediate tube that extends axially within the center body and a first diluent passage defined therebetween;

an annular disk disposed at a downstream end of the first intermediate tube, wherein the disk is axially offset upstream from a downstream surface of the center body, wherein the disk defines a plurality of circumferentially spaced vanes which provide for fluid communication from the first diluent passage through the disk;

a second intermediate tube that extends axially within the first intermediate tube and through an opening defined by the disk, wherein the second intermediate tube and the first intermediate tube define a second diluent passage therebetween;

an inner tube that extends axially within the second intermediate tube, wherein the inner tube defines a first fuel passage therein and the inner tube and the second intermediate tube define a second fuel passage therebetween, the first fuel passage terminating at first fuel port defined in an end wall that extends radially between a downstream end of the inner tube and a downstream end of the second intermediate tube, the second fuel passage terminating at a plurality of second fuel ports annularly arranged around the first fuel port proximate to the end wall; and a flow sleeve circumferentially surrounding an end portion of the second intermediate tube and extending axially through the disk opening, the flow sleeve and the end portion of the intermediate tube defining an annular flow passage therebetween, wherein the flow sleeve defines a plurality of circumferentially spaced radial passages in fluid communication with the second diluent passage and the annular flow passage;

wherein an outer surface of the flow sleeve and an inner wall portion of the center body defines a first diluent outlet downstream from the vanes of the disk and an outer surface of the second intermediate tube and an inner surface of the flow sleeve define a second diluent outlet proximate to the end wall of the center body;

wherein at least one fuel port of the plurality of second fuel ports is angled with respect to an axial centerline of the fuel nozzle assembly to impart at least one of radial and azimuthal swirl to a liquid fuel exiting the at least one fuel port.

18. The combustor as in claim 17, wherein the fuel nozzle assembly further comprises a fuel swirler disposed within the inner tube and in fluid communication with the first fuel passage upstream from the first fuel port.

19. The combustor as in claim 17, wherein at least one fuel port of the plurality of second fuel ports extends through the end wall.

20. The combustor as in claim 17, wherein at least one fuel port of the plurality of second fuel ports extends through a radially outer surface of the second intermediate tube proximate to the second diluent outlet.

* * * * *